US006644918B2

(12) United States Patent
Masuo

(10) Patent No.: US 6,644,918 B2
(45) Date of Patent: Nov. 11, 2003

(54) AXIAL FLOW FAN MOTOR

(75) Inventor: Satoshi Masuo, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/092,776

(22) Filed: Mar. 8, 2002

(65) Prior Publication Data

US 2002/0127109 A1 Sep. 12, 2002

(30) Foreign Application Priority Data

Mar. 9, 2001 (JP) ..... 2001-066674

(51) Int. Cl.[7] ..... F04D 29/38

(52) U.S. Cl. ..... 415/220; 416/203

(58) Field of Search ..... 415/175, 177, 415/178, 220; 416/203, 175

(56) References Cited

U.S. PATENT DOCUMENTS 4,253,800 A * 3/1981 Segawa et al. ..... 416/203
4,930,984 A * 6/1990 Kesel et al. ..... 416/203
6,488,472 B1 * 12/2002 Miyazawa ..... 416/144
6,491,499 B1 * 12/2002 Marvin et al. ..... 416/203

* cited by examiner

*Primary Examiner*—Ninh H. Nguyen
(74) *Attorney, Agent, or Firm*—Oliff & Berridge, PLC

(57) ABSTRACT

In an axial flow fan motor having openings through which air can flow linearly in the axial direction provided between a plurality of blades which rotate along with the rotation of the motor, the plurality of blades are arranged at different intervals or at equal intervals every other blade circumferentially around the rotation axis of the motor. With this axial flow fan motor, when two axial flow fan motors are stacked in the axial direction and either one is selectively used, the blades of the other fan motor that is stopped do not obstruct airflow from the fan motor that is being driven.

1 Claim, 5 Drawing Sheets

AXIAL FLOW FAN MOTOR

BACKGROUND OF THE INVENTION

1. Field of the Invention

The present invention relates to an improvement of an axial flow fan motor to be used for such purposes as heat radiation of office automation (OA) equipment and the like.

2. Description of Related Art

In OA equipment, such as personal computers and copy machines, many electronic components are housed within the casing thereof. Accordingly, the temperature in the casing rises due to the heat generated by these electronic components such that the electronic components way be damaged or their characteristics degraded by the heat. Recently there has been a rising demand to make equipment smaller so that electronic components are housed tightly packed within the casing, which markedly increases the possibility of this type of damage by heat.

In regard to this, damage by heat can be prevented by providing an air flow hole in the casing of the equipment and installing an axial flow fan motor there so that the heat within the casing can be forcibly discharged outside.

However, the method of forcibly discharging heat using a motor leads to a critical problem in that almost all of the heat discharging functionality is lost if the motor fails. The main conventional method to avoid this problem is to arrange two axial flow fan motors stacked in the axial direction in the air flow hole of the casing.

This is normally done to maintain the heat discharging functionality by driving one of the two axial flow fan motors, and driving the other if the first fails.

In this case, however, of the two axial flow fan motors, the blades of the fan motor which is stopped obstruct the airflow from the fan motor which is being driven. Because of this, a fan motor with fewer blades has been used. This type of conventional axial flow fan motor is shown in FIG. 6.

As shown in the figure, this type of axial flow fan motor has a casing 1 in which a ventilation hole 1*a* is formed in the center portion thereof, an outer rotor motor 2 fixed in the center of the ventilation hole 1*a*, and blades 3 attached to the outer periphery of this motor 2.

In this case, a plurality of blades 3, three here, are mounted to the outer periphery of the motor 2 by being formed on the outer periphery of a ring 4, as shown in FIG. 7, and this ring 4 then being fitted and fixed around the outer periphery of the motor 2 (rotor outer periphery) shown in FIG. 6.

Accordingly, the blades 3 rotate along with the driving of the motor 2 (rotor rotation) This forces air flow in the axial direction of the motor, thus discharging heat from within the casing of the equipment.

Referring to FIG. 6, reference numeral 1*b* denotes a mounting hole for mounting the axial flow fan motor to the equipment casing and the like (not shown); reference numeral 5 denotes a spoke used for supporting the motor 2; and reference numeral 6 denotes an electric power supply wire.

The conventional axial flow fan motor is provided with fewer blades 3 than usual, as is evident from FIG. 7, and there is a large opening between adjacent blades 3 and 3.

As a result, a large opening 7 through which air can flow linearly in the axial direction is formed between the blades 5 and 3. Therefore, when two of this type of fan motor are stacked in the axial direction, as shown in FIG. 8, the degree to which the blades 3 of the fan motor that is stopped, for example, a fan motor 61*b* (see FIG. 6), obstruct the air flow (see arrow $\alpha$) from the fan motor that is being driven, for example, the fan motor 61*a*, is decreased. Also, airflow in the axial direction of the motor when the motor is stopped is improved even if only one fan motor is being used.

On the other hand, however, this leads to a problem of decreased airflow, for which there has been demand for improvement.

SUMMARY OF THE INVENTION

In view of the foregoing demand, it is an object of the present invention to provide an axial flow fan motor capable of improving airflow in the axial direction of the motor when the motor is stopped, while minimizing a decrease of airflow.

In order to achieve this object, according to a first aspect of the present invention, an axial flow fan motor comprises a casing having a ventilation hole formed in the center portion thereof, a motor fixed in the center of the ventilation hole, and a plurality of blades which rotate around a motor rotation axis along with rotation of the motor, which has openings enabling air flow linearly in the axial direction between the blades, wherein the plurality of blades are arranged at different intervals circumferentially around the rotation axis of the motor.

According to a second aspect of the present invention, an axial flow fan motor comprises a casing having a ventilation hole formed in the center portion thereof, a motor fired in the center of the ventilation hole, and a plurality of blades which rotate around a motor rotation axis along with rotation of the motor, which has openings enabling air flow linearly in the axial direction between the blades, wherein the plurality of blades are arranged at equal intervals every other blade circumferentially around the rotation axis of the motor.

According to the present invention as described above, in an axial flow fan motor having openings through which air can flow linearly in the axial direction provided between a plurality of blades which rotate around the rotation axis of the motor along with the rotation of the motor, the plurality of blades are arranged at different intervals or at equal intervals every other blade circumferentialy around the rotation axis of the motor. As a result, a decrease in airflow can be minimized while airflow in the axial direction of the motor when the motor is stopped can be increased.

Therefore, in an application in which one or more fan motors, of a plurality of axial flow fan motors of the present invention as described above which are stacked in the axial direction, is optionally selected to be used, the degree to which the blades of the fan motor(s) that is slopped obstruct the air flow from the fan motor(s) that is being driven is decreased. Moreover, a decrease in airflow can meanwhile be minimized.

DETAILED DESCRIPTION OF PREFERRED EMBODIMENTS

Hereinafter, embodiments of the present invention will be described in accordance with the drawings.

Figure 1:
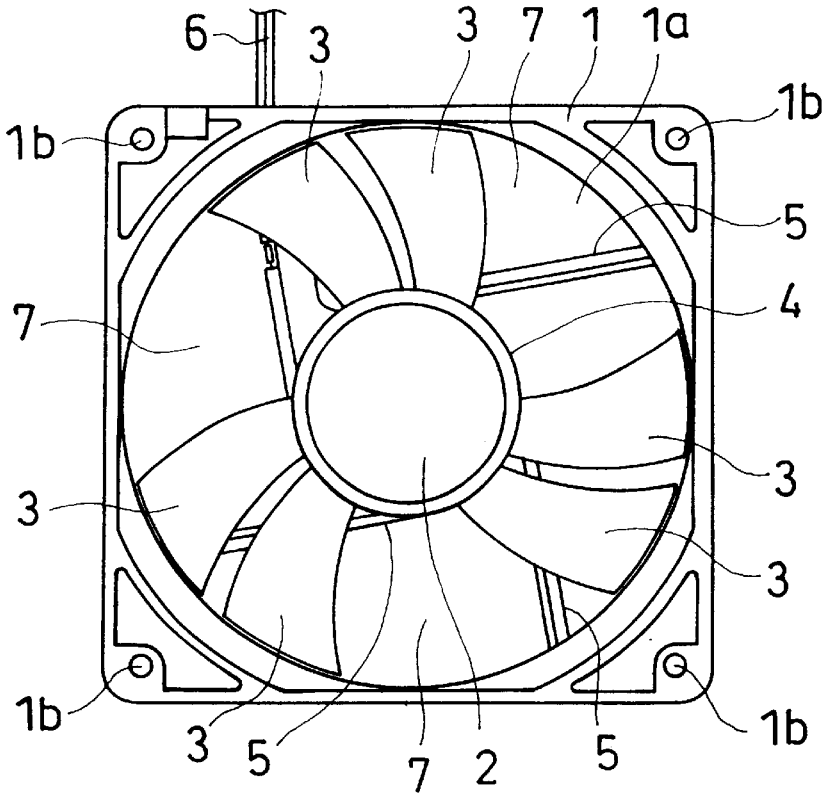
FIG. 1 is a front view of one embodiment of the axial flow fan motor according to the present invention.

FIG. 1 is a front view showing one embodiment of the axial flow fan motor according to the present invention. As shown in the figure, the axial flow fan motor of the present invention is provided with a casing 1 having a ventilation hole 1*a* formed in the center portion thereof a motor 2 fixed in the center of the ventilation hole 1*a*, and a plurality of blades 3 which rotate around a motor rotation axis along with the rotation of the motor 2.

As in the depicted example, the casing 1 has a substantially square outer shape, with mounting holes 1*b* for mounting the axial flow fan motor to an equipment casing or the like (not shown) provided in each of the four corners and the ventilation hole 1*a* provided in the center portion. Also, the motor 2 is an outer rotor motor which is fixed in the center of the ventilation hole 1*a* by being supported with three spokes 5 extending from different locations on the edge of the opening of the ventilation hole 1*a*. A plurality, six here, of blades 3 are mounted on the outer periphery of this motor 2, or more specifically, on the outer periphery of the rotor of the motor 2.

Figure 2:
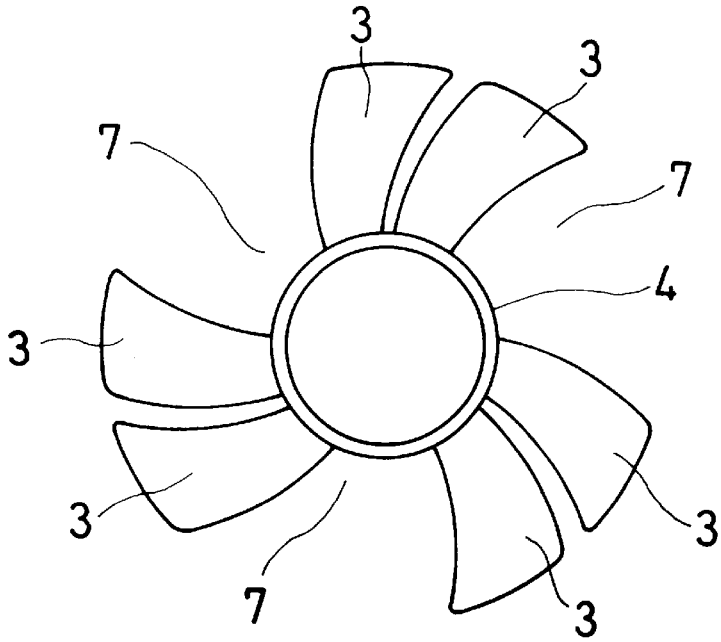
FIG. 2 is a rear view of a portion extracted from FIG. 1.

As shown in FIG. 2, the blades 3 are mounted on the outer periphery of the motor 2 by being formed on the outer periphery of a ring 4, this ring 4 then being fixed to the outer periphery of the motor 2 (rotor outer periphery) shown in FIG. 1.

Therefore, the blades 3 rotate as the motor 2 is driven (the rotor is rotated) such that air flows in the axial direction of the motor, thus discharging heat from within the equipment casing.

Figure 3:
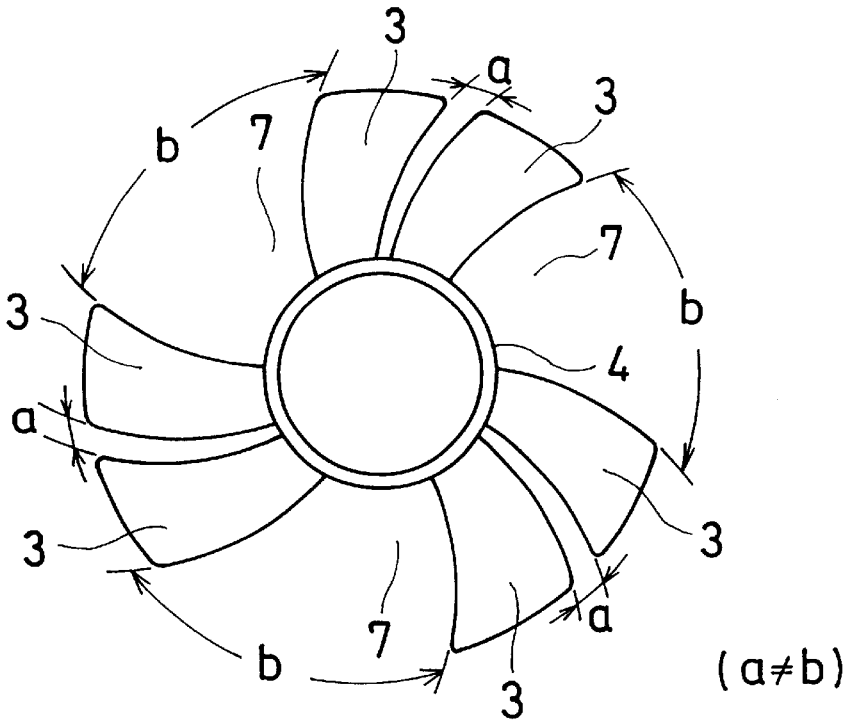
FIG. 3 is an explanatory view of the blades shown in FIG. 2 arranged at different intervals.
Figure 7:
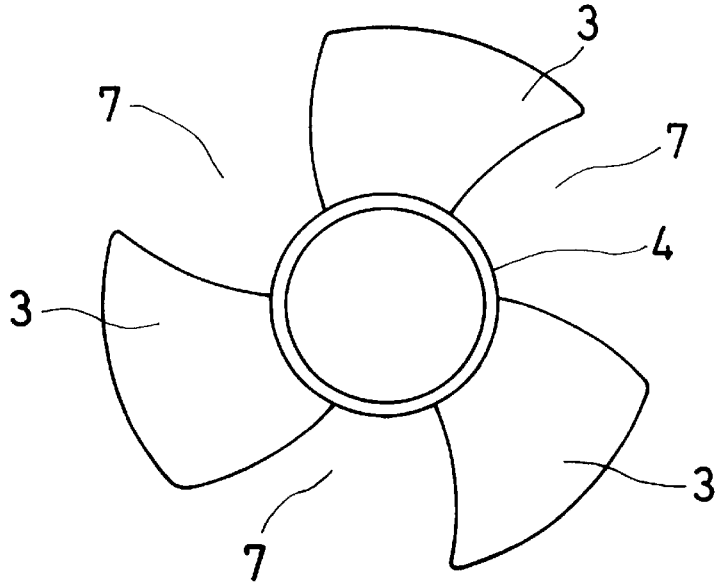
FIG. 7 PRIOR ART
FIG. 7 is a rear view of a portion extracted from FIG. 6.

The aforementioned six blades 3 . . . are arranged such that the intervals between adjacent blades 3 and 3 circumferentially around the rotation axis of the motor 2 differ, unlike the equal intervals such as with the conventional axial flow fan motor shown in FIG. 7. FIG. 3 is an explanatory view of this, with intervals a and b having the relationship of $a \neq b$.

With the example shown in FIG. 2, the six blades 3 . . . are arranged at equal intervals every other blade (each of the even number blades or odd number blades 3 at equal intervals) on the outer periphery of the rotor of the motor 2, while adjacent blades 3 and 3 are arranged at different intervals circumferentially around the rotation axis of the motor 2.

Figure 4:
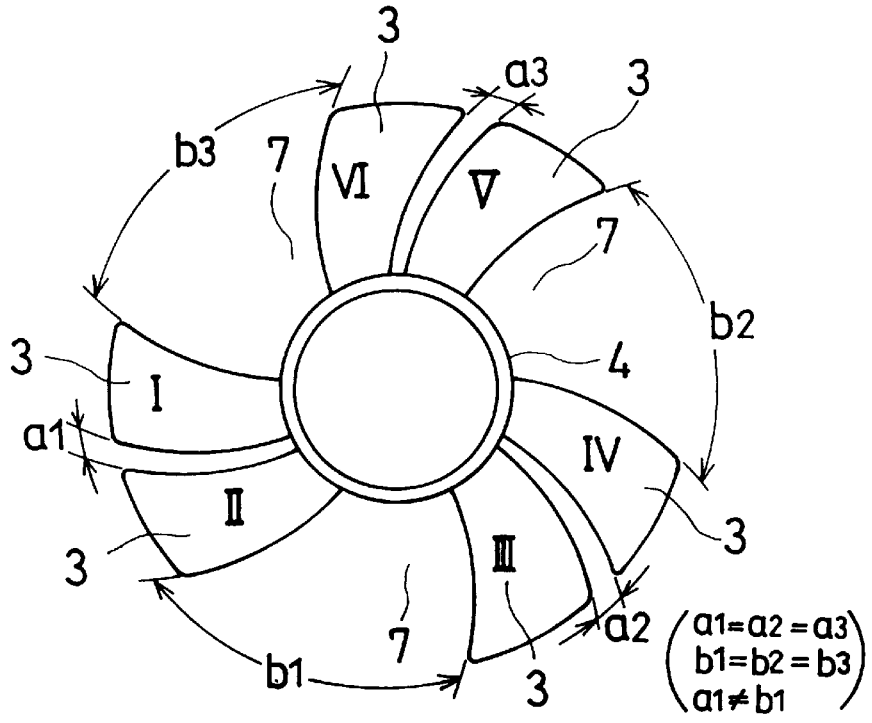
FIG. 4 is an explanatory view of the blades shown in FIG. 2 arranged at equal intervals every other blade.

FIG. 4 is a diagram that explains the arrangement of the six blades 3 at equal intervals every other blade. As shown in the figure, intervals a1 through a3 and b1 through b3 have a relationship in which $a1=a2=a3$, $b1=b2=b3$, and $a1 \neq b1$. Each of the blades 3 . . . is of the same shape (identical dimensions). Therefore, of the blades 3 . . . , the odd number blades I, III, and V are arranged each at equal intervals. Further the even number blades II, IV, and VI are also arranged at equal intervals (each of the blades 3 . . . are arranged at equal intervals every other blade). Also in FIG. 4, it is evident that the intervals between adjacent blades 3 and 3, that is, between the odd number and even number blades (blades I and II, II and III, . . . VI and I), differ just as $a1 \neq b1$, $b1 \neq a2$, . . . $b3 \neq a1$.

Figure 6:
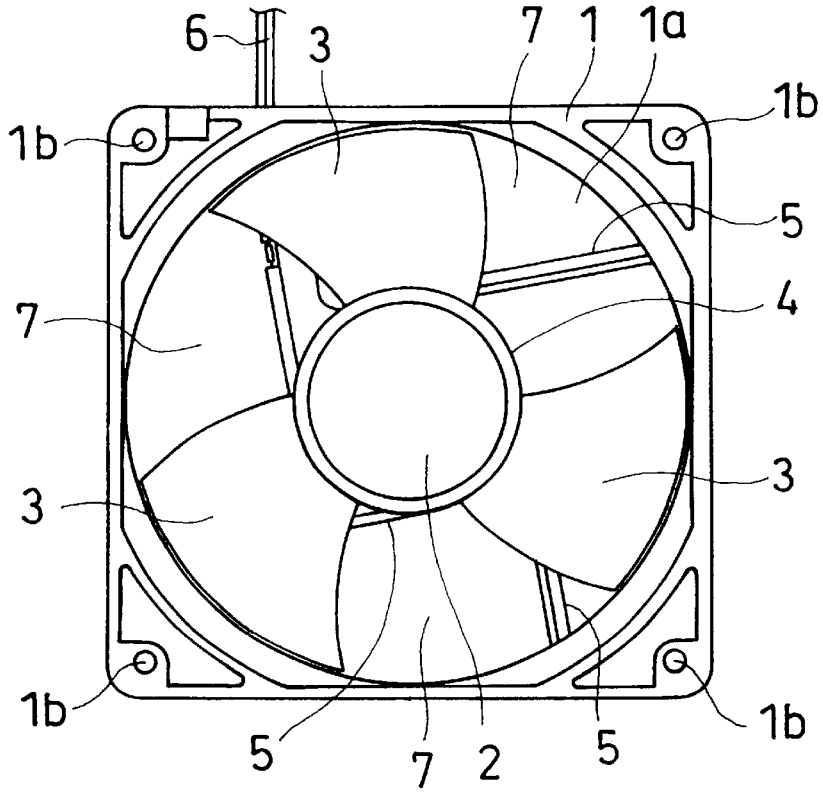
FIG. 6 PRIOR ART
FIG. 6 is a front view of a conventional axial flow fan motor.

On one hand, between adjacent blades 3 and 3 circumferentially around the rotation axis of the motor 2, large openings 7 which enable airflow linearly in the axial direction are formed, just as with the conventional axial flow fan motor 2 shown in FIGS. 6 and 7. In the example shown in FIG. 2, the aforementioned opening 7 is formed between the even number and odd number blades 3 and 3 counting clockwise from the blade 3 in the top vertical position.

Figure 8:
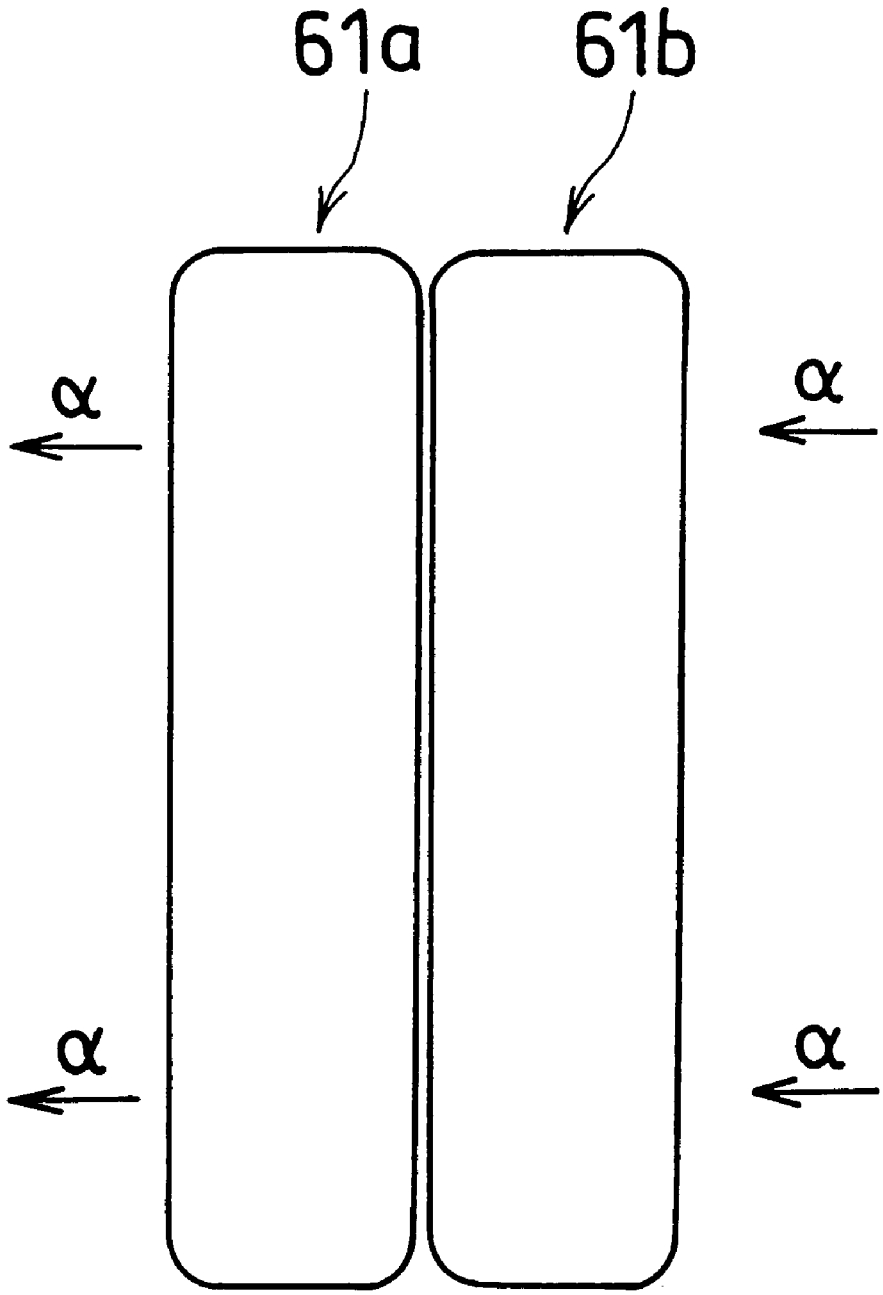
FIG. 8 is a side view of two axial flow fan motors stacked in the axial direction.

Therefore, airflow in the axial direction of the motor when the motor is stopped is improved just as with the conventional axial flow fan motor shown in FIG. 6. Also in particular, as shown in FIG. 8, in application in which one of two axial flow fan motors 61 (61*a* and 61*b*) stacked in the axial direction is optionally selected to be used, the degree to which the blades 3 of the fan motor 61*b* that is stopped (see FIG. 1) obstruct the air flow (see arrow $\alpha$) from the fan motor 61*a* that is being driven is decreased.

On the other hand, however, whereas with the conventional axial flow fan motor shown in FIG. 6 the airflow is decreased, with the axial flow fan motor of the present invention the degree of airflow decrease is minimized as described below.

Figure 5:
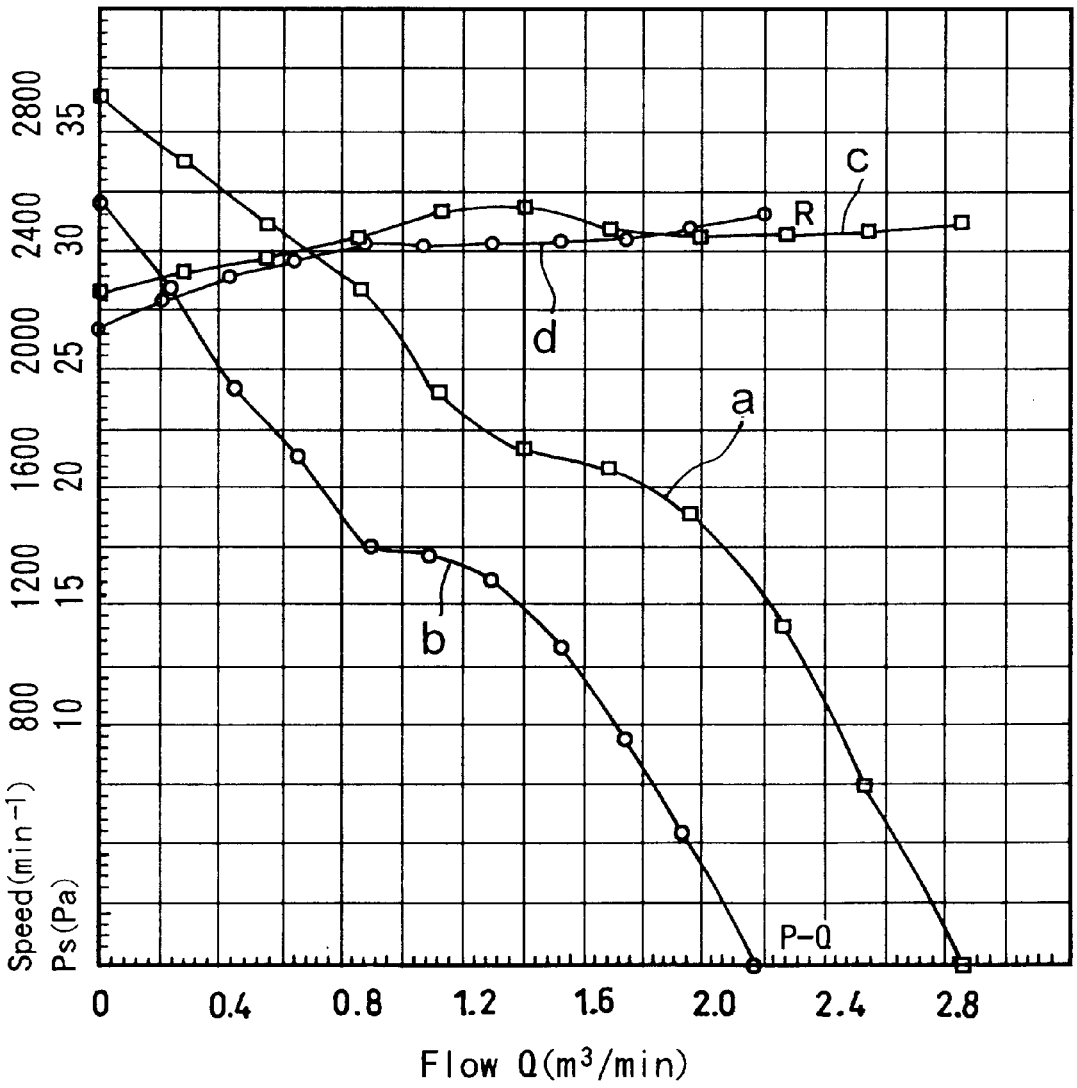
FIG. 5 is a graph showing a comparison between the P–Q characteristics of the axial flow fan motor of the present invention and those of a conventional axial flow fan motor.

That is, FIG. 5 is a graph showing a comparison of the P (static pressure) Q (airflow) characteristics of the axial flow fan motor of the present invention (the article of the present invention) shown in FIG. 1 and the conventional axial flow fan motor (the conventional article) shown in FIG. 6. The curved line a shows the P–Q characteristics of the article of the present invention and the curved line b shows the P–Q characteristics of the conventional article.

With the article of the present invention, particularly the embodiment shown in FIG. 1, six blades 3 are arranged at equal intervals every other blade circumferentially around the rotation axis of the motor 2 (arranged with different intervals between adjacent blades 3 and 3 circumferentially around the rotation axis of the motor). As a result, the article of the present invention has an increase in static pressure of approximately 10% and an increase in airflow of a little over 20% compared with the conventional article, Referring to FIG. 5, the curved line c shows the rotation speed—airflow characteristics of the article of the present invention and the curved line d shows those of the conventional article.

In the embodiment described above, an outer rotor motor is used as the motor for rotating the blades; however it is not limited thereto. A conventional inner rotor motor may also be used.

In the embodiment described above, an axial flow fan motor of the art present invention is used to discharge heat from within an equipment casing; however it may also be used to create airflow in the direction opposite that in the above-described embodiment so as to take outside air into the casing or the like.

What is claimed is:

1. An axial flow fan motor unit in which two axial flow fan motors are stacked in an axial direction, wherein each of said axial flow fan motors comprises:

a casing having a ventilation hole formed in a center portion thereof, a motor fixed in a center of said ventilation hole, and a plurality of blades which rotate around a motor rotation axis along with rotation of said motor, and has openings enabling air flow linearly in the axial direction between said blades, wherein characterized in that said plurality of blades is arranged at equal intervals every other blade circumferentially around the rotation axis of said motor, and said plurality of blades arranged circumferentially around the rotation axis of said motor has two kinds of intervals.

* * * * *